US006888921B2

(12) United States Patent
Wake

(10) Patent No.: US 6,888,921 B2
(45) Date of Patent: May 3, 2005

(54) LASER PLASMA X-RAY GENERATING APPARATUS

(75) Inventor: Fumio Wake, Hyogo (JP)

(73) Assignee: Teikoku Electric Mfg. Co., Ltd., Hyogo (JP)

( * ) Notice: Subject to any disclaimer, the term of this patent is extended or adjusted under 35 U.S.C. 154(b) by 124 days.

(21) Appl. No.: 10/612,409

(22) Filed: Jul. 3, 2003

(65) Prior Publication Data

US 2004/0062352 A1 Apr. 1, 2004

(30) Foreign Application Priority Data

Jul. 4, 2002 (JP) ..... 2002-196581

(51) Int. Cl.[7] ..... H01J 35/32
(52) U.S. Cl. ..... 378/122
(58) Field of Search ..... 378/119, 122; 250/504 R

(56) References Cited

FOREIGN PATENT DOCUMENTS

JP 01006349 A 10/1989

OTHER PUBLICATIONS

Mochizuki "Laser plasma x–ray source by cryogenic target and high–rep rate slab YAG laser," *High–Power Lasers in Energy Engineering* 3886: 306–319 (Nov., 1999).

*Primary Examiner*—Craig E. Church
(74) *Attorney, Agent, or Firm*—Browdy and Neimark, P.L.L.C.

(57) ABSTRACT

A laser plasma X-ray generating apparatus that can promptly repair a cryo-target layer on a drum surface held at a very low temperature using a liquid nitrogen is provided, and a drum 122 is fixed to a lower end of a shaft 121, and the drum 122 is arranged so as to be able to be moved in its rotating direction and its axle direction at an inside of the cryo-forming cover 106. And a liquid nitrogen supplying pipe 131 is inserted into the shaft 121, and a conduit 144 for supplying the target gas is connected to the cryo-forming cover 106. Further, a jacket 171 is arranged at the periphery of the cryo-forming cover 106 and a pipe 185 is arranged at the periphery of the conduit 144, resulting in forming a heat exchanger. A vapor gas of liquid nitrogen is drawn from a gap S between the shaft 121 and the pipe for supplying the liquid nitrogen 131, introducing the vapor gas between the conduit 144 and the pipe 185, further introducing the vapor gas into an inside of the jacket 171, resulting in cooling the target gas, so that efficiency of attachment of the target material is improved.

3 Claims, 5 Drawing Sheets

LASER PLASMA X-RAY GENERATING APPARATUS

BACKGROUND OF THE INVENTION

1. Field of Invention

The present invention relates to a laser plasma X-ray generating apparatus in which a pulse laser beam having a high-peak power that is repeatedly outputted at a predetermined frequency is converged and irradiated so as to use a solid target material as a target, thereby producing high-temperature-and-high-density plasma, and continuously and repeatedly generating a pulse X-ray (laser plasma X-ray) from the high-temperature-and-high-density plasma, particularly a laser plasma X-ray generating apparatus in which a target material that is chemically inactive and lies in a gas-state at a room temperature is made to be in contact with a surface of a rotating body that has been cooled at a very low temperature using a liquid nitrogen or the like, and the cryo-target layer is fixed and built up on the rotating surface by the cooling to be a target for irradiation of the pulse laser beam.

2. Description of the Prior Art

In a laser plasma X-ray generating apparatus in which a pulse laser beam having a high-peak power that is repeatedly outputted by a predetermined frequency is converged to a point whose diameter is 100 $\mu$m or less, and irradiated to a solid target material as a target, thereby producing a high-temperature-and-high-density plasma, so that a high-luminous pulse X-ray is generated from the generated high-temperature-and-high-density plasma and thereafter the pulse X-ray is used for X-ray lithography or a light source used for a mirror of an X-ray microscope or the like, means for forming a cryo-target layer at a converging and irradiating point of the pulse laser beam by continuously supplying liquefied or solidified rare gas such as Kr, Xenon, Argon, or the like that is chemically inactive and lies in a gas-state at a room temperature as a target material so as to be built up on a surface of the rotating body is e.g. disclosed in Japanese laid-open patent publication 6349/1989 (JP Pat. No. 2,614,457). According thereto, an apparatus using a rotating endless-belt has been conventionally known.

The apparatus disclosed in Japanese laid-open patent publication 6349/1989, as shown in FIG. 5, is provided with a belt-conveyor 3 having a rotating endless belt 2 being continuously moved at an inside of a vacuum chamber 1, a liquefied or solidified cryo-target material 4 is, by way of a supplying conduit 6 from a target material supplying apparatus 5, continuously supplied onto a surface of the rotating endless belt 2 and thereafter attached to the surface of the rotating endless belt 2, resulting in forming a cryo-target layer 7. A pulse laser beam 11 from a pulse laser generating apparatus 10 is, by way of a laser converging lens 9, incident from an incidence opening 8 at a sidewall of the vacuum chamber 1, and the cryo-material on the cryo-target layer 7 at a converging and irradiating point 12 on a surface of the rotating endless belt 2 is changed into the material lying in a plasma-state resulting in radiating a pulse X-ray 13, and thereafter the pulse X-ray 13 is drawn from an X-ray exit 14 toward outside. The cryo-target layer 7 in which crater holes remain after having been changed into a plasma-stated layer by converging irradiation of the pulse laser beam 11, is moved together with the rotating endless belt 2. The crater holes are repaired by continuously supplying a cryo-target material onto the surface of the moving rotating endless belt 2.

Further, apart from the above apparatus, very recently, according to "Proc. SPIE Vol.3886 (1999)", a method is disclosed that in place of the belt conveyor, a target material such as a rare gas, etc. that is chemically inactive and lies in a gas-state at a room temperature is continuously supplied in the gas-state and condensed, resulting in forming a cryo-target layer on the surface of the rotating cylindrical body, and the cryo-target layer formed on the surface of the rotating cylindrical body is moved in its rotating direction and its axle direction of the rotating cylindrical body, resulting in that the solidified cryo-material is supplied to a converging and irradiating point.

Among the above-mentioned prior arts, in the method of supplying a target material that has be beforehand liquefied or solidified, the attachment of the target material is instable, resulting in that the cryo-target layer cannot be surely formed.

On the other hand, in the method of supplying a target material such as a rare gas, etc. that is chemically inactive and lies in a gas-state at a room temperature to the surface of the rotating cylindrical body that has been cooled at a very low temperature, and condensed, resulting in forming a cryo-target layer, the attachment of the target material is stable, resulting in that the cryo-target layer can be surely formed. However, even when the cryo-target layer is formed using this method, hemisphere-shaped crater holes are generated at the converging and irradiating point on the surface of the formed cryo-target layer by plasma operation by converging and irradiation of the pulse laser beam. Therefore, even if a pulse laser beam is again irradiated to the portion where the crater holes have been generated, stability of the converging degree is deteriorated, a pulse X-ray performing high average output that is stably outputted cannot be continuously and repeatedly generated. Therefore, in order to promptly repair the cryo-target layer in which the crater holes have been generated, a target material is continuously supplied, and the supplied target material lying in a gas state is enclosed at the periphery of the rotating cylindrical body using the wall such as a cryo-state forming cover.

However, in the prior art, the target material which allows the cryo-target layer to be formed by condensing the target material on the surface of the rotating cylindrical body that has been cooled at a very low temperature, is supplied as it stands at a room temperature, resulting in that a molecule energy is large, so that efficiency of attachment of the target material onto the cryo-target layer on the surface of the rotating cylindrical body that has been cooled at the very low temperature is deteriorated, the attachment speed is slow, therefore the cryo-target layer cannot be promptly repaired.

OBJECTS AND SUMMARY OF THE INVENTION

The object of the present invention is to provide a Laser plasma X-ray generating apparatus in which a target material such as a rare gas that is chemically inactive and lies in a gas-state at a room temperature is supplied under a gas-state, and condensed resulting in forming a cryo-target layer, and repairing a cryo-target layer promptly.

A laser plasma X-ray generating apparatus is provided, in which a target material that is chemically inactive and lies in a gas-state at a room temperature is supplied under a gas-state to contact with an exterior surface of a rotating cylindrical body which is cooled at a very low temperature using a refrigerant carrier such as a liquid nitrogen thereby being cooled and solidified, resulting in-forming a cryo-target layer which is built up on an exterior surface of the rotating cylindrical body;

a pulse laser beam having a high-peak power that is repeatedly outputted at a desired frequency is converged and irradiated onto a surface of the cryo-target layer, while by displacement of said rotating cylindrical body in its rotating direction or its axle direction, or by displacement thereof of combination of both in its rotating direction and in its axle direction, the surface of the rotating cylindrical body having the cryo-target layer is moved in its surface direction with relative to a converging and irradiating point of said pulse laser beam that is fixed in a space manner;

a high-temperature and high-density plasma is produced by converging and irradiating the pulse laser beam, while a cryo-target layer on which crater holes generated by plasma operation by converging and irradiating of the pulse laser beam is repaired by continuously supplying the target material thereto; and a pulse X-ray is continuously and repeatedly generated from the high-temperature and high-density plasma, the laser plasma X-ray generating apparatus being characterized in that the target material supplied onto the exterior surface of the rotating cylindrical body lying in a gas-state is cooled using a gas at a very low temperature that is generated from the refrigerant carrier used for cooling the rotating cylindrical body.

More specifically, according to the above-mentioned laser plasma X-ray generating apparatus, the target material is cooled by introducing the gas at the very low temperature that is generated from the refrigerant carrier used for cooling the cylindrical body to the periphery of a conduit for transporting the target material toward the exterior surface of the rotating cylindrical body lying in a gas state. Also the target material is cooled by introducing the gas at the very low temperature that is generated from the refrigerant carrier used for cooling the cylindrical body to the periphery of wall for enclosing the transported target material under the gas-state at the periphery of the rotating cylindrical body.

The target material that is chemically inactive and lies in a gas-state at a room temperature is supplied to the laser plasma X-ray generating apparatus. And the target material under its gas-state is in contact with the exterior surface of the rotating cylindrical body that is cooled at a very low temperature and cooled and condensed to be built-up on the exterior surface of the rotating cylindrical body, resulting in forming a cryo-target layer. A pulse laser beam having a high-peak power is converged and irradiated onto a surface of said cryo-target layer, so that the high-temperature and high-density plasma is generated resulting in generating the pulse X-ray from the high-temperature and high-density plasma.

Further, by displacement of the rotating cylindrical body in its rotating direction or its axle direction, or by displacement thereof of combination of both in its rotating direction and in its axle direction, a surface of the rotating cylindrical body having the cryo-target layer is moved in its surface direction, with relative to a converging and irradiating point of the pulse laser beam that is fixed in a space manner, the converging and irradiating point is moved on the surface of the rotating cylindrical body, simultaneously, during that time, the target material is continuously supplied, so that the cryo-target layer in which crater holes are generated by plasma operation by converging and irradiating of the pulse laser beam is repaired. For the same period, the target material to be supplied to the exterior surface of the rotating cylindrical body in a gas state is, by way of conduits and a wall portion that encloses the target material at the periphery of the rotating cylindrical body, cooled using the gas at a very low temperature to be generated from the refrigerant carrier used for cooling the rotating cylindrical body, resulting in that the target gas is changed into a gas whose molecule energy is small is supplied thereto. Therefore, efficiency of attachment of the target material onto the cryo-target layer on the surface of the rotating cylindrical body that is cooled at a very low temperature is improved, resulting in that the cryo-target layer is surely and promptly repaired. And the pulse laser beam to be repeatedly outputted at a predetermined frequency is sequentially converged and irradiated onto a portion where the surface of the cryo-target layer is repaired, and the pulse X-ray is continuously repeatedly generated.

Thus, the target material to be supplied to the exterior surface of the rotating cylindrical body in a gas-state is cooled using the gas at a very low temperature that is generated from the refrigerant carrier used for cooling the rotating cylindrical body, resulting in that the cryo-target layer can be surely and promptly repaired. Further, the target material is cooled using the gas at a very low temperature to be generated from the refrigerant carrier used for cooling the rotating cylindrical body, so that the refrigerant carrier such as a liquid nitrogen is not only merely used cooling the rotating cylindrical body but also reused effectively, resulting in saving energy and that a configuration of the apparatus is simple, and the apparatus can be miniaturized.

The above, and other objects, features and advantages of the present invention will become apparent from the following detailed description which is to be read in conjunction with the accompanying drawings.

DESCRIPTION OF THE PREFERRED EMBODIMENTS

Figure 1:
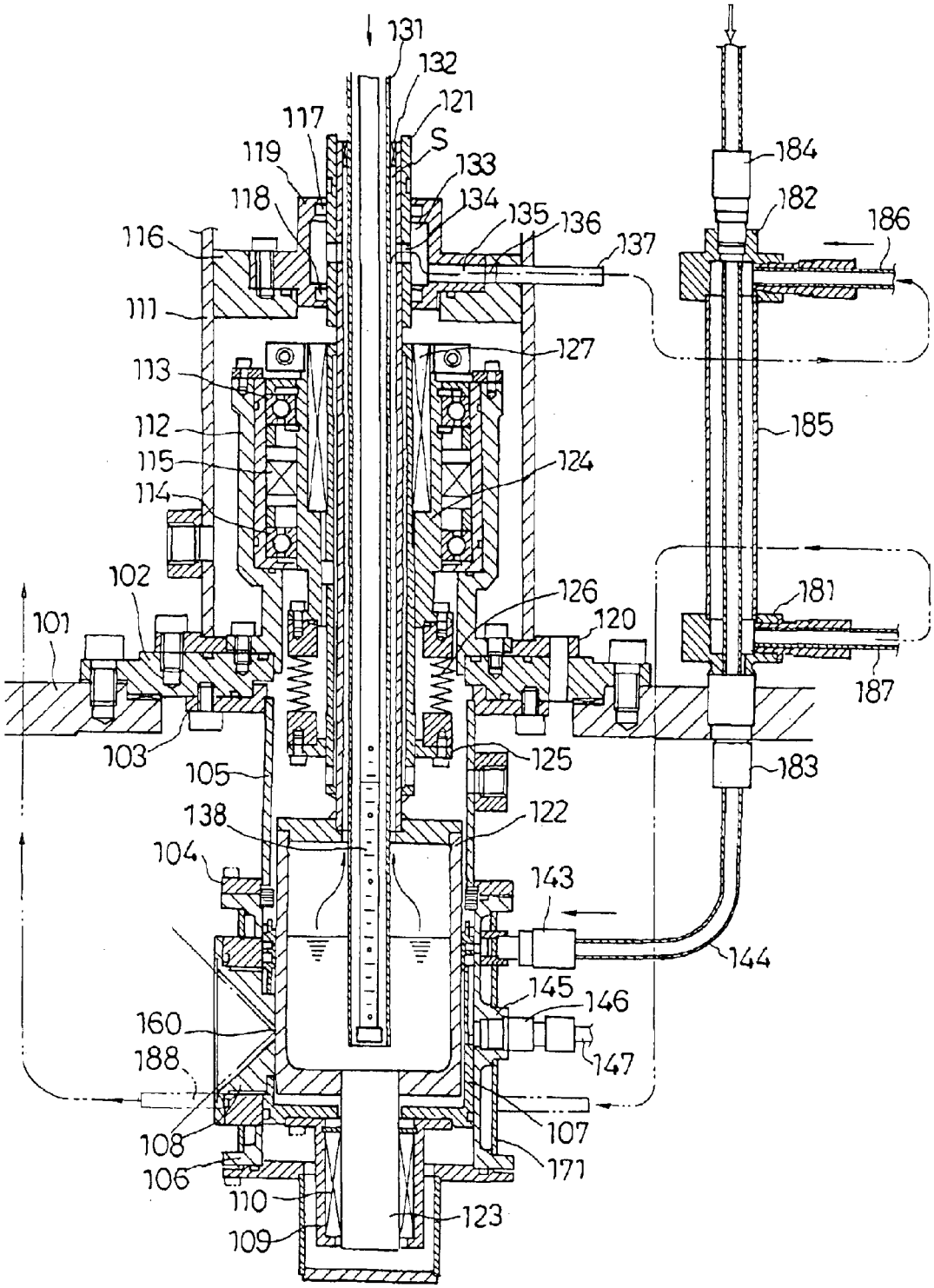
FIG. 1 is an vertical sectional view of one example of a laser plasma X-ray generating apparatus of aspect of embodiment of the present invention.
Figure 2:
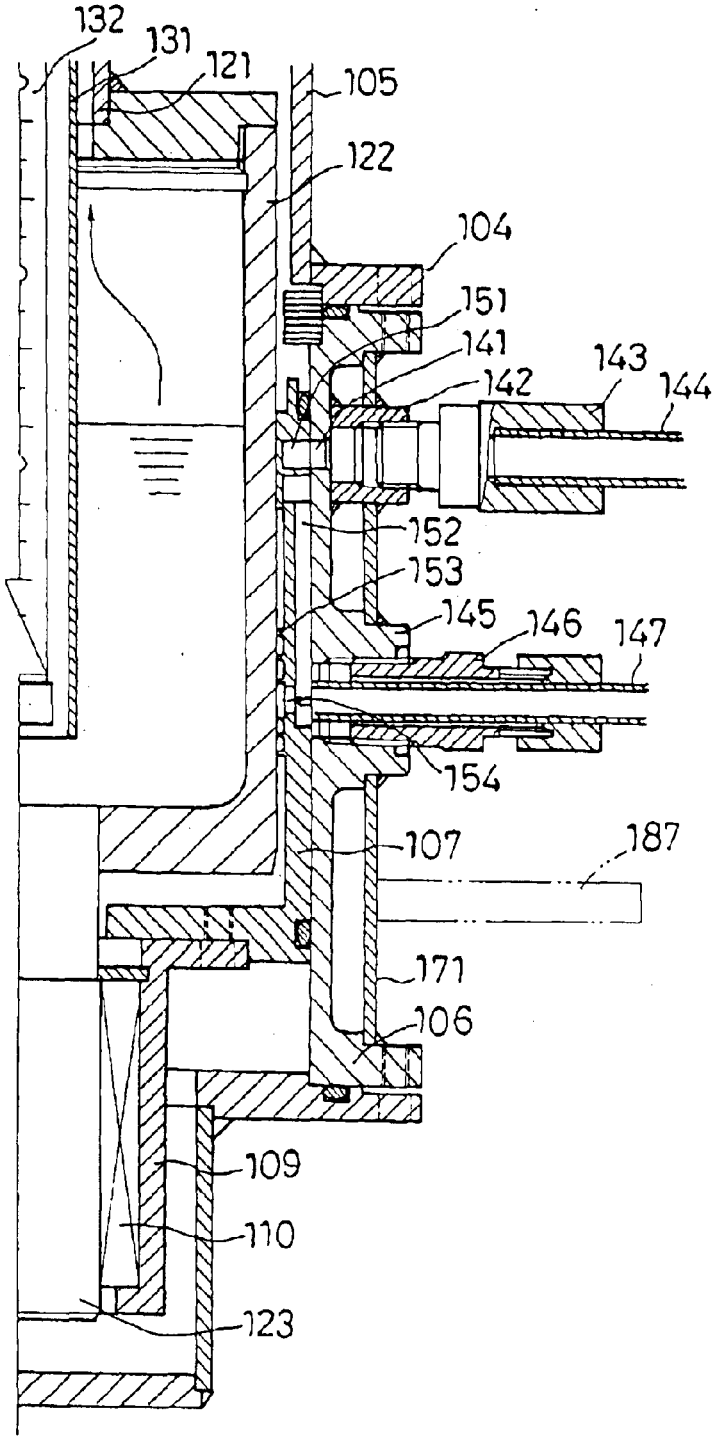
FIG. 2 is a partially detailed view of FIG. 1.

In the laser plasma X-ray generating apparatus of aspect of embodiment as shown in FIG. 1 and FIG. 2, a flange body 102 is bolt-fixed from above to a horizontal flame 101 whose center portion is opened. A substantially cylindrical cryo-cover 106 is arranged in a vertical state and bolt-jointed to the flange body 102 from below by way of a jointing sleeve 105 being integrally welded to flange-shaped jointing portions 103 and 104 at both upper and lower ends.

A substantially cylindrical copper ring 107 is fitted so as to be in contact with an inner surface of the cryo-forming cover 106 and maintained at a desired location with a stop screw attached to a boss portion of the cryo-forming cover 106. Also, an under portion of the copper ring 107 is cylindrically formed having a bottom. A bearing holder 109 is bolted to the lower bottom surface of the bottom cylindrical portion from below. A journal bearing 110 is held to the bearing holder 109.

Further, a substantially cylindrical vacuum cover 111 is arranged in a vertical state at a top surface of the flange body 102 and bolted by way of an integrally welded and flange-shaped joint portion 120, and a bearing assembly holder 112 whose diameter is smaller than a diameter of the vacuum cover 111 and that is substantially cylindrical, is also arranged and bolt-fixed, lying in a vertical state so as to be surrounded by the vacuum cover 111.

Roller bearings 113 and 114 are held at an inside of the bearing assembly holder 112 in arrangement having upper and lower steps, and a magnetic seal 115 is arranged in the middle of the upper and lower roller bearings 113 and 114.

The vacuum cover 111 forms a sealed space at the periphery of and above the bearing assembly holder 112, the sealed space is maintained in an evacuated state using a vacuum pump (not shown). A ring-shaped partition 116 is integrally welded so as to be inwardly projected above the bearing assembly holder 112. A seal holder 119 that holds seals 117 and 118 at two steps of upper and lower are arranged to the ring-shaped partition 116 from above and bolt-fixed.

Further, though followings are not shown, a drive mechanism provided with motors for rotating and vertical displacing are arranged above the vacuum cover 111. And a pipe-shaped shaft 121 that is driven in its vertical direction and its rotating direction using the drive mechanism is arranged vertically, penetrating through inside of the vacuum cover 111. A drum 122 as a rotating cylindrical body being moved in its rotating direction and in its axle direction is integrally welded to a lower end extending portion of the shaft 121, having a constant gap at an inside circumferential portion of the copper ring 107 at an inside of the cryo-forming cover 106.

A drum 122 has a shaft portion 123 protruding downwardly at a center of its bottom portion. The shaft portion 123 is supported using the journal bearing 110 held by the bearing holder 109.

On the other hand, a guide sleeve 124 being rotated integrally with inner rails of the rolling bearings 113 and 114 held at an inside of the bearing assembly holder 112 is mounted so as to be relatively displaced in its axle direction. A flange-shaped projecting portion 125 is provided on an outer circumferential portion positioned below the guide sleeve 124 and above a drum 122. A bellows 126 is arranged, surrounding the shaft 121 between a lower end of the guide sleeve 124 and an upper end of the flange-shaped projecting portion 125. A bearing 127 is mounted, surrounding the shaft 121 at an above and inner circumferential side of the guide sleeve 124.

A liquid nitrogen supply pipe 131 is inserted into an inside of the shaft 121 so as to arrive at the inner lower portion of the drum 122. The liquid nitrogen supply pipe 131 is used for introducing a liquid nitrogen to be supplied from a liquid nitrogen supply opening (not shown) at an upper portion of the apparatus into an inside of the drum 122. The pipe 131 whose outer diameter is smaller than an inner diameter of the shaft 121, is arranged so that a gap S is formed at its periphery. A level gauge 138 is inserted at an inside of the liquid nitrogen supply pipe 131.

The gap S between the shaft 121 and the liquid nitrogen supply pipe 131 is opened for an inside of the drum 122 at a lower portion, and sealed using a seal 132 at an above portion of the seal holder 119, e.g. as shown.

A circular recess 133 is formed at an inner circumferential portion sandwiched between an upper step 117 and a lower step 118 at the seal holder 119. A lateral opening 134 is formed that allows the gap S at the periphery of the liquid nitrogen supply pipe 131 to be opened for the circular recess 133 at an inner circumferential portion of the seal holder 119, at the shaft 121. And a communicating opening 135 is formed at the seal holder 119 so as to be in communication with the circular recess 133 at an inner circumferential portion of the seal holder 119 to be extended laterally. An unloading opening 136 in communication with the communicating opening 135 is formed at the partition 116. A pipe inserting opening 137 being opened for the unloading opening 136 of the partition 116 is formed at the vacuum cover 111.

A target gas introducing opening 141 is provided at an upper and lateral position opposing to a position into and with which an irradiating flange 108 is inserted and fitted, at the cryo-forming cover 106, and an inlet fitment 142 for conduit-connection is welded and fixed so as to be in communication with the opening 141. And a target gas supplying pipe 144 is connected to the inlet fitment 142 by way of a connecting fitment 143.

Further, a boss portion 145 for installing a temperature sensor is formed at a lower portion of the opening 141 for introducing the target gas, at the cryo-forming cover 106. A pipe 147 for inserting the temperature sensor is connected to the boss portion 145 by way of a mounting fitment 146.

A circumferential recess 151 is formed so as to have two steps at an outer circumferential portion of its upper end, at the copper ring 107. The two steps of circumferential recesses 151 are vertically communicated together at a desired position, and in communication with the lower step circumferential recess 151. At the outer surface of the copper ring 107, plural longitudinal recesses 152 communicating with the lower step circumferential recess 151 are formed so as to extend downwardly at a desired interval in its circumferential direction. At the inner circumferential side of the copper ring 107, there exists a constant gap (G) between the drum 122 and each of an inner circumferential surface at the upper end portion which has a circumferential recess 151 at its outer circumferential portion and circular ribs 153 at an inner circumferential side of plural steps of upper and lower which are formed at upper and lower portions of a position which are arranged in its circumferential direction with relative to an incident and outgoing opening 160 of an irradiating flange 108. In a configuration where a gap larger being equal to or than the gap (G) between any of portions except for them and an outer circumferential portion of the drum 122 can exist, a communicating opening 154 that allows the longitudinal recess 152 lying at the outer circumferential side to be in communication with a potion between two circular ribs 153 lying at the middle step.

Further, a jacket 171 is welded and fixed to the cryo-forming cover 106 so as to form a sealed space at its periphery.

The target gas supplying conduit 144 connected to the inlet fitment 142 that is in communication with the opening 141 of the cryo-cover 106 by way of the connecting fitment 143, penetrates through a three-way nipple 181 fixed to the frame 101 and a three-way nipple 182 arranged upward of the nipple 181 and extends upward of the frame 101, sealed and fixed to the nipples 181 and 182, by way of connecting fitments 183 and 184, and a pipe 185 is installed between the upper nipple 181 and the lower nipple 182 so that a sealed space is formed at the periphery of the conduit 144.

The conduit 144 between the upper nipple 181 and the lower nipple 182 and the pipe 185 constitute a gas cooling heat exchanger. A conduit 186 for taking out a vapor gas generated within the drum 122 and introducing the vapor gas between the pipe 185 and the conduit 144 between the upper and lower nipples 181 and 182.

A conduit 187 for introducing the vapor gas flown between the conduit 144 and the pipe 185 to a sealed space within the jacket 171 is connected to the lower nipple 181. The vapor gas flown between the conduit 144 of the gas cooling heat exchanger and the pipe 185, passes through the conduit 187 to be introduced to a sealed space within the jacket 171 and flown at the periphery of the cryo-forming cover 106, and released into an air through a conduit 188 at an outlet end.

In the laser plasma X-ray generating apparatus, liquid nitrogen as a refrigerant carrier is introduced into an inside of the drum 122 by way of the liquid nitrogen supplying pipe 131, the drum 122 is cooled, and its external surface is held at a very low temperature. And a target material (rare gas such as Krypton, Xenon, and Argon) that is chemically inactive and that lies in a gas-state at a room temperature is supplied from the conduit 144 as a target gas. The target gas flows from the opening 141 of the cryo-forming cover 106 into a circumferential recess 151 at the upper step of the copper ring 107, and flows through the upper and lower steps of the circumferential recesses 151 and flows through the longitudinal recess 152 and jets from the communication opening 154 toward the exterior surface of the drum 122. The jetted target material contacts with the surface of the drum and thereafter the material is cooled and condensed, so that the target material is built-up on an exterior surface of the drum 122, resulting in forming a cryo-target layer.

The drum 122 is moved in its rotating direction and its axle direction together with the shaft 121. And by a pulse laser beam generating apparatus (not shown), a pulse laser beam having a high-peak power and that is repeatedly outputted at a desired frequency is incident through the opening of the irradiation flange 108, and the beam is converged and irradiated onto the surface of the cryo-target layer at a converging and irradiating point that is fixed in a space state and that is positioned at the vicinity of the external surface of the drum 122. A high-temperature and high-density plasma is produced, and thereafter a pulse X-ray is generated from the high-temperature and high-density plasma. Further, by moving the drum 122 in its rotating direction and its axle direction, with relative to the converging and irradiating point of the pulse laser beam that has been fixed in a space state, the drum surface in which the cryo-target layer is formed is moved in its surface direction. The converging and irradiating point of the pulse laser beam is moved, drawing a desired locus on the surface of the drum 122. For the same period, the target gas is continuously supplied, and the cryo-target layer in which crater holes have been generated by plasma operation using converging and irradiation of the pulse laser beam is repaired. Then the pulse X-ray is continuously and repeatedly generated by converging and irradiation of the pulse laser beam to be repeatedly outputted at a desired frequency.

And just then, a vapor gas of liquid nitrogen is generated within the drum 122. The vapor gas rises up through a gap S between the shaft 121 and the liquid nitrogen supplying pipe 131, drawn by way of the conduit 186 and introduced into the pipe 185 of the gas cooling exchanger. And, here, the target gas flowing through the conduit 144 is cooled by thermal exchange of the vapor gas.

Further, the vapor gas flown between the conduit 144 of the gas cooling heat exchanger and the pipe 185 is introduced to a sealed space in the jacket 171 by way of the conduit 187 and flows through a peripheral portion of the cryo-forming cover 106, so that the cryo-forming cover 106 is cooled and the copper ring 107 in contact with the cryo-forming cover 106 is cooled. Therefore, the target gas is further cooled, when the target gas flows from the opening 141 of the cryo-forming cover 106 into the circumferential recess 151 lying at the upper step of the copper ring 107, flows through the upper and lower circumferential recesses 151, and flows through the longitudinal recess 152. Thereafter, the target gas is changed into a gas whose molecule energy is small at a low temperature, and supplied onto the external surface of the drum 122. Therefore, efficiency of attachment of the target material onto the cryo-target layer of the surface of the drum 122 which has been cooled at a very low temperature, is improved, so that the cryo-target layer can be surely and promptly repaired.

Figure 3:
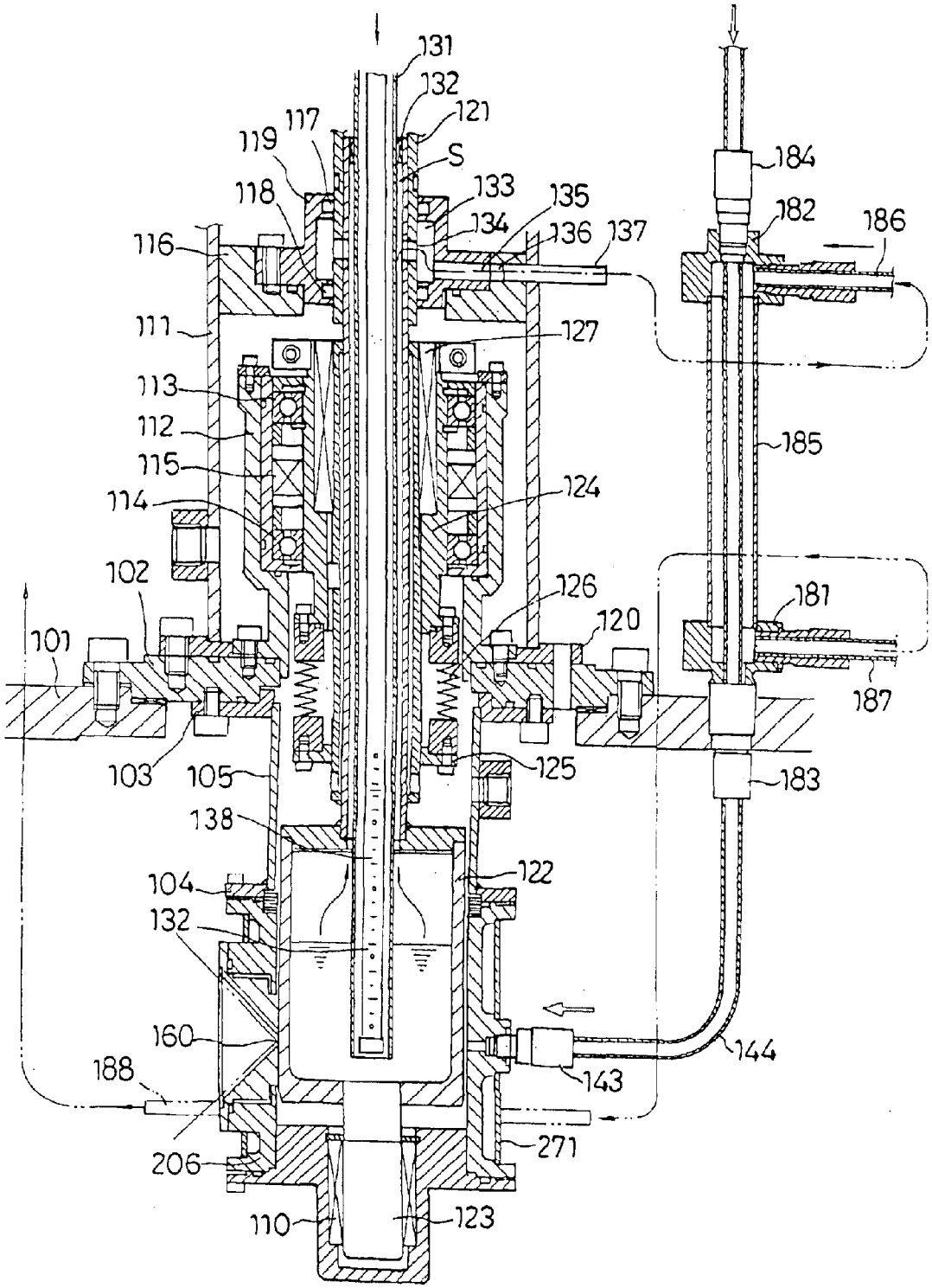
FIG. 3 is an vertical sectional view of one modified example of the laser plasma X-ray generating apparatus of aspect of embodiment of the present invention.
Figure 4:
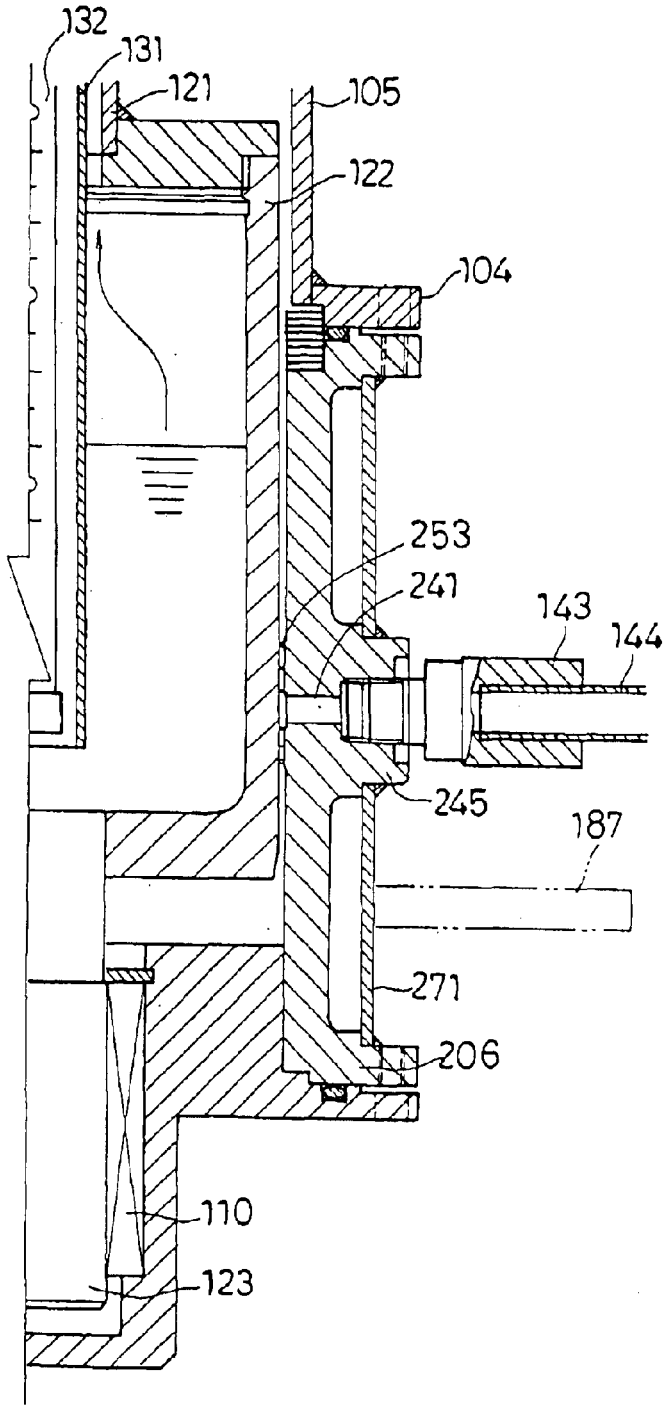
FIG. 4 is a partially detailed view of FIG. 3.
Figure 5:
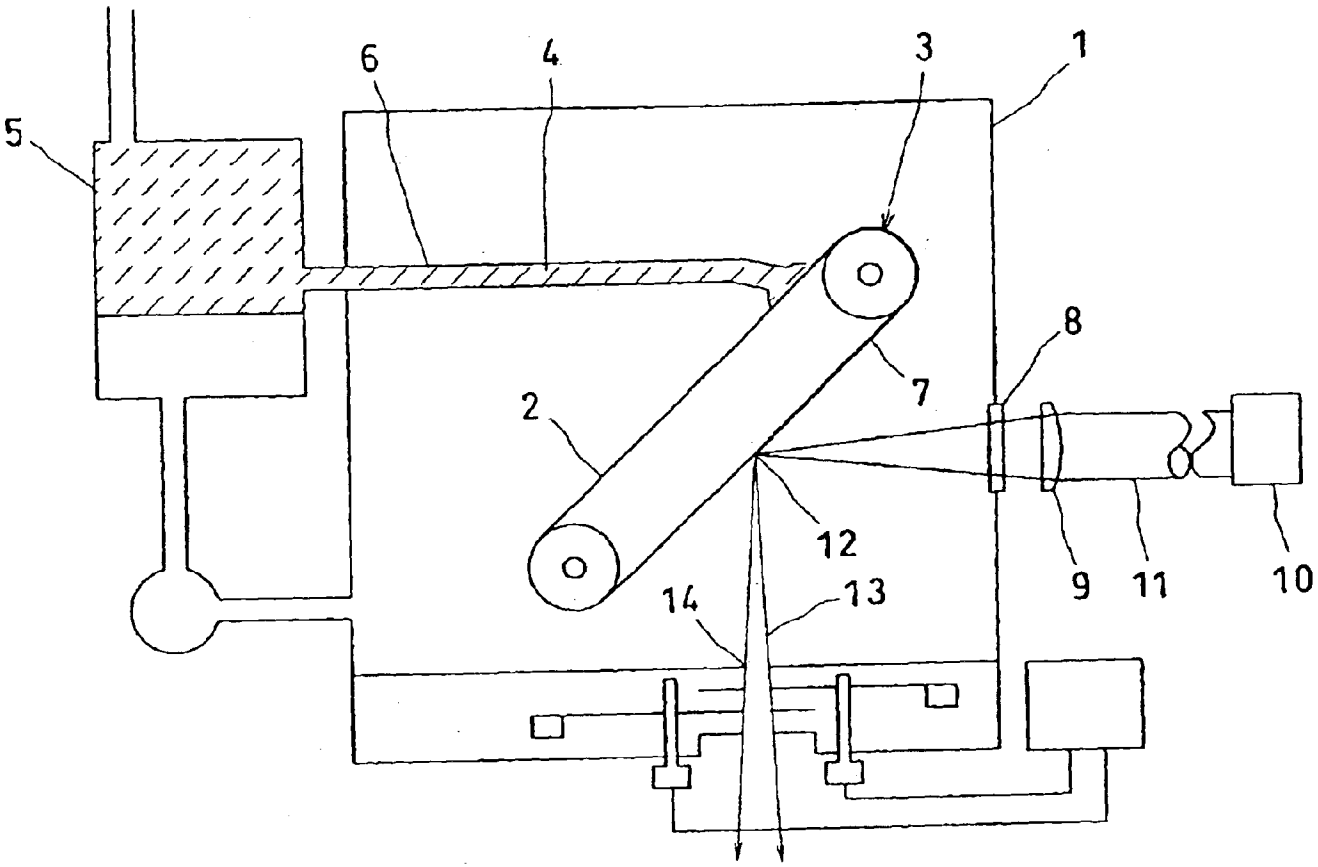
FIG.5 PRIOR ART
FIG. 5 is a schematic configuration view of the conventional plasma laser plasma X-ray generating apparatus.

Until now, one example of the present embodiment has been explained. The laser plasma X-ray generating apparatus may, as shown in FIG. 3 and FIG. 4, be modified into the apparatus having no copper ring 107. FIG. 3 is a vertical sectional view of the laser plasma X-ray generating apparatus. FIG. 4 is a partially detailed view of FIG. 3. Hereinafter, the same numerals are labeled to the common portions between the modified laser plasma X-ray generating apparatus and the laser plasma X-ray generating apparatus shown in FIG. 1 and FIG. 2. A specified configuration will be mainly explained.

The laser plasma X-ray generating apparatus shown in FIG. 3 and FIG. 4 is constituted so that a circular rib 253 at an inner circumferential portion of the cryo-forming cover 206 is in contact with an outer circumferential portion of the drum 122. The circular ribs 253 are formed by plural steps of upper and lower which are arranged in the circumferential direction with relative to at an incident and outgoing opening 160 of the irradiating flange 108, and an opening 241 is provided for introducing a target gas between two circular ribs 253 lying at the middle step. Further, a portion where the opening 241 is provided, constitutes a boss portion 245. A conduit 144 for supplying a target gas is, by way of a connecting fitment 143, connected to the boss portion 245. A jacket 271 is welded and fixed over the boss portion 245. Further, a lower portion of the cryo-forming cover 206 constitutes a bearing holder portion, at which a journal bearing 110 is held.

In the laser plasma X-ray generating apparatus as shown in FIG. 3 and FIG. 4, a target gas supplied from the conduit 144 is directly jetted from the opening 241 of the cryo-forming cover 206 toward an exterior surface of the drum 122. And the target gas is cooled by thermal-exchanging the target gas by a vapor gas of a liquid nitrogen which has been introduced into an inside of a pipe 185 of the gas cooling thermal exchanger. Further, the cooled target gas is, by way of the conduit 187, introduced to a sealed space in the jacket 271 thereby cooling the cryo-forming cover 206 and further cooled when flowing through the boss portion 245 of the cryo-forming cover 206. Therefore, the target gas is also changed into a gas whose molecule energy is small at a low temperature to be supplied to an exterior surface of the drum 122, resulting in improving that efficiency of attachment of the target material onto the cryo-target layer on the surface of the rotating cylindrical body which has been cooled at a very low temperature, so that the cryo-target layer can be surely and promptly repaired.

Until now, one example and the modified example of the present embodiment have been explained, but the present invention is not limited thereto. Needless to say, the present invention can be carried out by appropriately modifying a configuration within a scope of technical idea of the invention.

What is claimed is:

1. A laser plasma X-ray generating apparatus in which:

a target material that is chemically inactive and lies in a gas-state at a room temperature is supplied under a gas-state to contact with an exterior surface of a rotating cylindrical body which is cooled at a very low temperature using a refrigerant carrier such as a liquid nitrogen and thereby being cooled and solidified, resulting in forming a cryo-target layer which is built up on an exterior surface of said rotating cylindrical body;

a pulse laser beam having a high-peak power that is repeatedly outputted at a desired frequency is converged and irradiated onto a surface of said cryo-target layer, while by displacement of said rotating cylindrical body in its rotating direction or its axle direction, or by displacement thereof of combination of both in its rotating direction and in its axle direction, the surface of said rotating cylindrical body having said cryo-target layer is moved in its surface direction with relative to a converging and irradiating point of said pulse laser beam that is fixed in a space manner;

a high-temperature and high-density plasma is produced by converging and irradiating said pulse laser beam, while a cryo-target layer on which crater holes generated by plasma operation by converging and irradiating of said pulse laser beam is repaired by continuously supplying said target material thereto; and a pulse X-ray is continuously and repeatedly generated from said high-temperature and high-density plasma, said laser plasma X-ray generating apparatus being characterized in that said target material supplied under a gas-state onto said exterior surface of said rotating cylindrical body is cooled using a gas at a very low temperature that is generated from the refrigerant carrier used for cooling said rotating cylindrical body.

2. The laser plasma X-ray generating apparatus according to claim 1 characterized in that said target material is cooled by introducing said gas at the very low temperature that is generated from said refrigerant carrier used for cooling said cylindrical body to the periphery of a conduit for transporting said target material toward said exterior surface of said rotating cylindrical body lying in a gas state.

3. The laser plasma X-ray generating apparatus according to claim 1 or 2 characterized in that said target material is cooled by introducing said gas at the very low temperature that is generated from said refrigerant carrier used for cooling said cylindrical body to the periphery of wall for enclosing said transported target material under the gas-state at the periphery of said rotating cylindrical body.

* * * * *